US007938733B1

(12) United States Patent
Bell

(10) Patent No.: US 7,938,733 B1
(45) Date of Patent: May 10, 2011

(54) GOLF SWING TRAINING DEVICE

(76) Inventor: Bradley E. Bell, Sacramento, CA (US)

( * ) Notice: Subject to any disclaimer, the term of this patent is extended or adjusted under 35 U.S.C. 154(b) by 0 days.

(21) Appl. No.: 12/914,621

(22) Filed: Oct. 28, 2010

(51) Int. Cl.
*A63B 69/36* (2006.01)

(52) U.S. Cl. ..... 473/220; 473/409

(58) Field of Classification Search ..... 473/220–227, 473/257, 266, 268, 422, 409
See application file for complete search history.

(56) References Cited

U.S. PATENT DOCUMENTS 5,082,282 A * 1/1992 Hernberg ..... 473/220
5,665,006 A * 9/1997 Pellegrini ..... 473/220
5,692,966 A * 12/1997 Wash ..... 473/221
6,488,592 B1 * 12/2002 Boatner ..... 473/220
* cited by examiner

*Primary Examiner* — Nini Legesse
(74) *Attorney, Agent, or Firm* — R. Michael West

(57) ABSTRACT

A golf swing training device comprising an illuminator mounted on the shaft of a golf club and a detector assembly including a light sensor strategically located around the stomach region of the golfer. The illuminator provides a relatively narrow beam of light wave energy, preferably along an axis that is generally coincident with the longitudinal axis of the club. The illuminator may be pulse modulated, to provide a frequency encoded light output. The detector assembly detects the light output from the illuminator, and produces a buzzing sound or a vibrating sensation, to alert the golfer that the club is following a correct path and position through the golf swing. The detector assembly may include optical filtering and signal conditioning to reduce the effects of ambient light. With such sensory feedback, the golfer develops muscle training for a consistent and correct swing pattern.

20 Claims, 3 Drawing Sheets

GOLF SWING TRAINING DEVICE

BACKGROUND OF THE INVENTION

1. Field of the Invention

The invention relates generally to improvements in devices for training golfers how to swing a golf club accurately and consistently. More specifically, the invention pertains to an illuminator mounted on the end of a golf club shaft and a detector assembly worn on the golfer, which together provide a perceptible signal to the golfer, confirming that the club has been maintained in the proper orientation through each swing.

2. Description of the Prior Art

Light sources have previously been used in various aspects of training devices intended to improve a golfer's swing. For example, in U.S. Pat. No. 5,082,282, issued to Hernberg, a Dual Light Source Golf Swing Trainer is shown. A first light source is provided on the club head directed downwardly, and a second light source is mounted on the upper end of the club shaft. A Detachable Golf Swing Training Device Using Two Light Beams is disclosed in U.S. Pat. No. 5,467,991, granted to White IV et al. The device of the '991 Patent is mounted along the club shaft, intermediate the club head and the grip, and illuminates in opposite directions. FIG. 4 shows how the illuminator directed toward the grip end of the shaft illuminates the ideal path for the club to follow during a swing.

A Golf Swing Training Device is shown in U.S. Pat. No. 5,665,006, issued to Pellegrini. This device is mounted on the upper end of the golf club shaft, and illuminates in a direction away from the head of the club. FIG. 3, in particular, shows the manner in which the illuminating beam assists the golfer in training to undertake a proper swing of the club. U.S. Pat. No. 5,655,973, granted to McPherson, Jr., teaches a Laser Golf Training Device. As shown in FIG. 1 of the '973 Patent, at the upper end of the backswing, the laser illuminator casts a light path on the ground which intersects the ideal path for the head of the club through the remainder of the swing.

Yet other devices have used both a light source and a light detector, as components in a golf training device. More particularly, in U.S. Pat. No. 5,692,966, issued to Wash, an illumination source and a light detector are located on the face of a golf putter alignment device, and a mirror or reflector is located on the face of the putter head. A Sporting Club Swing Trainer is illustrated in Patent Application Publication US 2009/0082122, filed by Kellogg. The golf club shaft end includes a light projector that sweeps a moving light beam along a path parallel to the face of the club. A light beam receiver is provided, including two rows of light detectors arranged in spaced relation. Electronic circuitry compares the output of the detectors, and determines whether an angular offset exists, as the light beam passes over the detectors. Lastly, in U.S. Pat. No. 6,458,038, granted to Lin, a Golf Putting Indication Device is shown, employing an illuminator on the club head, a light sensing unit including a plurality of photocells, and a display unit including a plurality of corresponding light emitting diodes.

SUMMARY OF THE INVENTION

The present invention comprises a golf swing training device having as one component thereof, an illuminator mounted preferably on the upper end of the shaft of a golf club. The illuminator is of compact design, including a laser diode and associated drive circuitry to pulse modulate or encode the light beam outputted by the diode. The laser diode is positioned so its narrow light beam is directed away from the club head, while having an orientation which is generally coincident with the longitudinal axis of the club shaft.

The other component is a detector assembly worn by the golfer. The detector assembly includes a light sensor strategically located around the stomach region of the golfer. The light sensor may comprise a photovoltaic cell or panel of relatively small size. The effective size and configuration of the cell may be varied through the use of differently configured external shrouds, fitted over the case holding the cell. This feature varies the size of the target for the illuminator, depending upon the expertise of the golfer.

The detector assembly also includes a transducer, which is electrically interconnected to the output of the light sensor. The transducer and the sensor may be located in the same housing, or they may be physically separated. If the units are separated, the transducer is preferably located on the belt of the golfer, and interconnected to the light sensor by a small wire.

The transducer produces a buzzing sound or a vibrating sensation, whenever the light sensor detects the light beam outputted from the illuminator. This buzz or vibration alerts the golfer that the club is following a correct path and position through the course of the golf swing. With such sensory feedback, the golfer develops muscle training for a consistent and correct swing pattern.

The operation of the transducer may be reversed, producing a buzzing sound or a vibratory sensation in the absence of a detected light beam. This is effected by simply flipping a switch on the transducer housing.

The detector assembly may also include optical filtering for the light sensor, and signal conditioning circuitry in the transducer. Both of these features are provided to enhance the overall signal to noise ratio of the system, thereby reducing the effects of ambient light.

DETAILED DESCRIPTION OF THE PREFERRED EMBODIMENT

Figure 1:
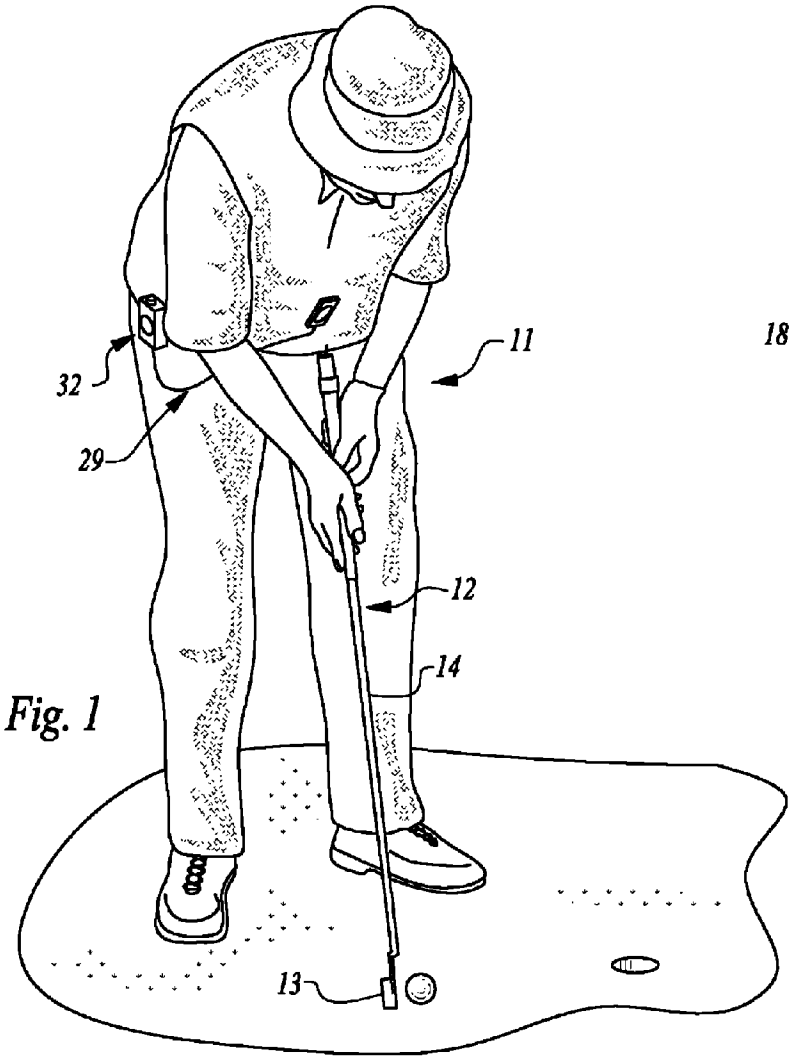
FIG. 1 is a perspective view of a golfer practicing putting, with the illuminator mounted on the upper end of the club shaft and the detector assembly being worn by the golfer.

The golf swing training device 11 disclosed herein is used in connection with a golf club, namely, a putter 12. Putter 12 includes a head 13, and a shaft 14 having an upper end 16. Putter 12 also has a longitudinal axis 17, shown in FIG. 2. Although the device 11 is primarily intended for use with training golfers in the use of putters, it may also be used with other golf clubs, where the stroke is similar to that of a putter.

An illuminator 18 is mounted on the upper end 16 of the shaft 14 by any convenient means. For example, a strip 19 of hook and loop material having an inner adhesive side 21 provides a simple and inexpensive means of attachment. One advantage of this arrangement is that the illuminator 18 can easily be removed either for service or to return the putter 12 to an unmodified condition. Lower coupler section 22 of illuminator 18 could also be screwed over the upper end 16 of shaft 14, provided both structures are provided with complementary threads (not shown). Or, coupler section 22 could simply be adhesively attached over upper end 16.

Illuminator 18 preferably includes a laser diode 23, producing a beam 24 of light wave energy. The 3 mw laser diode 23 provides an intense, collimated output anywhere within the general range of 640 nm to 760 nm. This red color frequency range is selected because it can readily be seen by the golfer during the day or night, and it can also be detected by many different light sensors. A laser diode also provides the advantage of having low power consumption, a desirable attribute for use in illuminator 18, a battery powered device. However, an LED or other source of light wave energy providing sufficient intensity at an appropriate light wave frequency may also be substituted.

Laser diode 23 is powered by a battery 26, providing low voltage DC to a driver 27. A switch 28 enables the golfer to turn illuminator 18 on and off as desired. Driver 27 is a conventional and inexpensive 555 timer, providing a stable current output at an AC frequency of approximately 1 khz, effective to pulse encode the beam 24 produced by laser diode 23. This frequency is not critical, but it is high enough to provide a light wave source which can be differentiated from the DC frequency of ambient light. This frequency of 1 khz is also low enough to minimize charge/discharge losses caused by capacitive reactance in the laser diode drive circuit.

Figure 2:
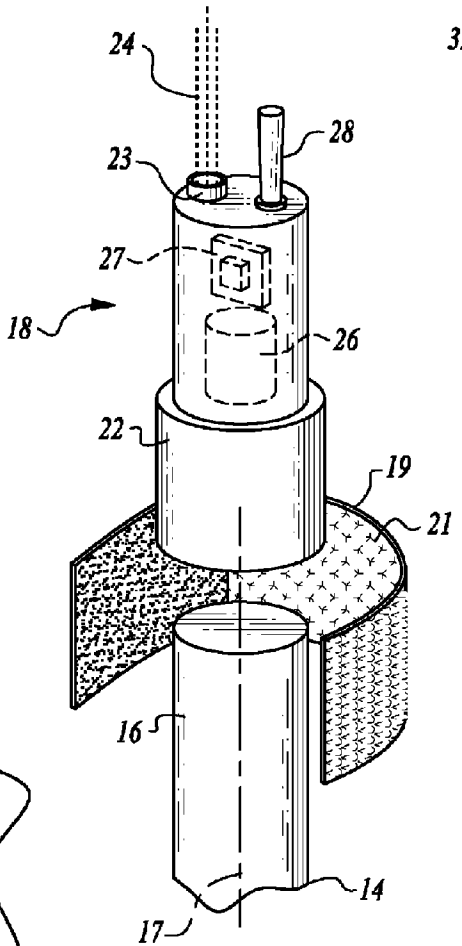
FIG. 2 is a fragmentary exploded perspective view of the upper end of the club shaft, showing the illuminator and a connector band.

As is evident from FIG. 2, beam 24 is directed away from the shaft 14 of putter 12, along a path which is generally coincident with and parallel to, the longitudinal axis 17 of the shaft 14. Laser diode 23 could also be located so that beam 24 is directly coincident with longitudinal axis 17, but for purposes of practicing the invention, it is only necessary that the beam 24 be generally coincident with and parallel to that axis. This direction and orientation for beam 24 ensures that the axis of putter 12 will be accurately projected onto the golfer so it can be detected and the golfer appropriately alerted.

For that purpose, a detector assembly 29 is provided, including a light sensor 31 and a transducer 32. Light sensor 31 includes a polycrystalline photovoltaic cell 33, selected for its ability to generate an AC square wave output 34 responsive to the beam 24, even in the presence of high levels of ambient light produced by the sun. Cell 33 also has the characteristic of being relatively large in size, on the order of 1" square, for practical use in the present application.

Light sensor 31 also includes a housing 36 to secure cell 33 and to provide a convenient means for attaching sensor 31 to the clothing of the golfer. Typically, the light sensor 31 is worn by the golfer during the training session, being strategically located around the stomach region of the golfer to define a target for the beam 24. During a putting stroke, it is generally advantageous for consistency and accuracy in the shot, to maintain the longitudinal axis 17 of the putter 12 directed toward the stomach of the golfer. Each golfer can experiment to find a particular location for light sensor 31, for example somewhere between the belt region to the upper stomach region, which is optimum for his putter and unique style of golfing. In any event, housing 36 may be attached to the clothing of the golfer by any convenient means including hook and loop strips, clips, or pins. (not shown).

Figure 9:
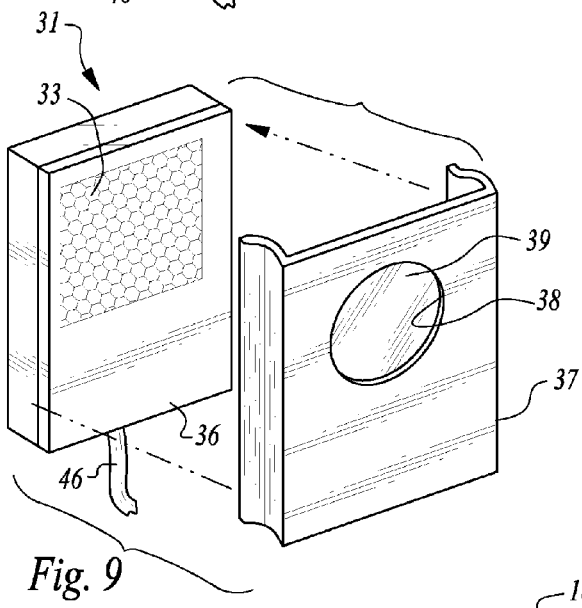
FIG. 9 is a perspective view of the light sensor shown in FIG. 7, being fitted with a circular target shroud to modify the size and configuration of the exposed portion of the cell.
Figure 10:
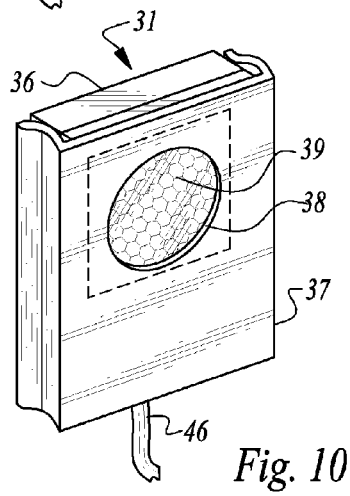
FIG. 10 is a view of the light sensor of FIG. 9, with the target shroud secured in place.
Figure 11:
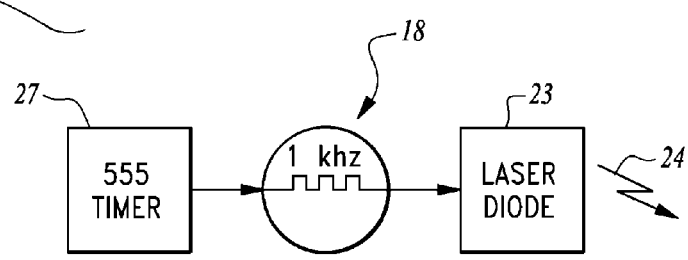
FIG. 11 is a functional block diagram of the illuminator.
Figure 12:
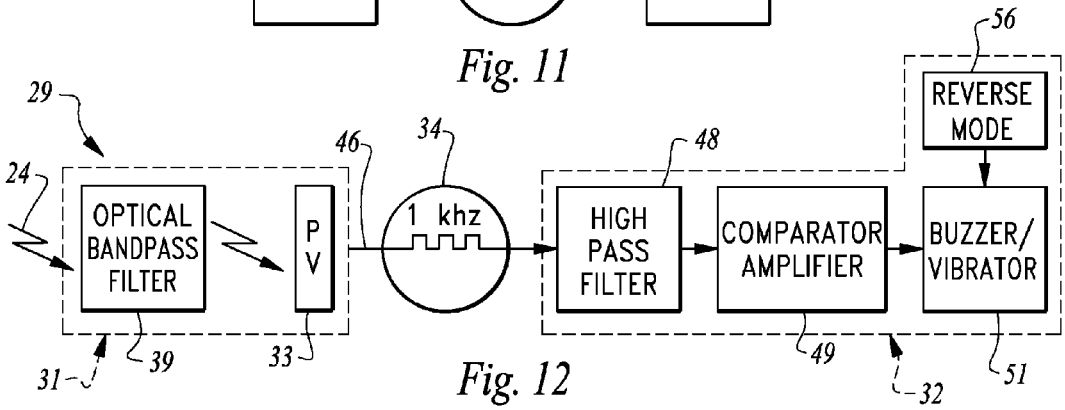
FIG. 12 is a functional block diagram of the detector assembly.

Housing 36 also provides a structure for a detachable shroud 37, providing a number of additional features. After a golfer has achieved a certain level of expertise and skill, it may be desirable to reduce the effective size of the target provided for the illuminator 18. For that purpose, shroud 37 including a circular cutout 38 may be clipped over the housing 36. The shroud 37 thereby reduces the exposed area of cell 33, and changes the target from a square configuration to a circular configuration. (See, FIGS. 9 and 10). It is apparent that the size and configuration of the cutout can be varied, depending upon the needs of the golfer.

In addition to the feature of varying the target size and configuration, an optical bandpass filter 39 may be included in circular cutout 38 to provide another operational feature. The light wave transmission characteristics of optical bandpass filter 39 are selected to pass light wave energy produced by the illuminator 18, and to absorb ambient light wave energy produced by the sun. The optical bandpass filter 39 will increase the signal to noise ratio of the system, and therefore the reliability of the operation of the transducer 32.

Figure 8:
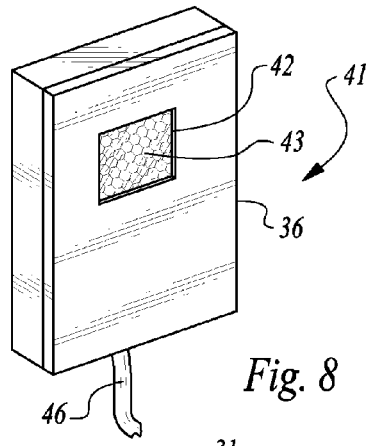
FIG. 8 is a perspective view of an alternative form of the light sensor, fitted with a substantially smaller photovoltaic cell for more experienced golfers.

Yet another light sensor 41, is shown in FIG. 8. In this construction, the housing 36 is the same size as that previously described, but the photovoltaic cell 42 is substantially smaller than cell 33. This arrangement, presenting a much smaller target for illuminator 18, would be appropriate for an advanced golfer. In addition, an optical bandpass filter 43 is directly affixed over the exposed portion of photovoltaic cell 42, making the aforementioned shroud unnecessary.

Transducer 32 preferably includes a housing 44 to confine and protect its various components. If transducer 32 is mounted on the golfer in a position remote from the light sensor 31, as shown in the drawings, a small cable 46 is provided to interconnect the two units and deliver the square wave output 34 of the cell 33 to the transducer 32. Typically, housing 44 would be secured by clip or clamp to the golfer's belt 47. Alternatively, light sensor 31 and transducer 32 may be mounted in a common housing (not shown), worn by the golfer in the proper position for the light sensor.

As its first internal component, transducer 32 includes a high pass filter 48. High pass filter 48 has a low frequency cutoff of 100 hz, and provides 6 db of loss for all signals below that frequency. This filter has proven effective in removing all ambient light DC output from the photovoltaic cell 33. The output of high pass filter 48 is then fed to amplifier means 49, to increase the amplitude of the detected square wave signal. A common and very high gain LM339 comparator chip was selected for amplifier means 49, to clean up and amplify the weak square wave signal outputted from high pass filter 48. The output of amplifier means 49 is effective to drive a either a buzzer or a vibrator 51.

Figure 3:
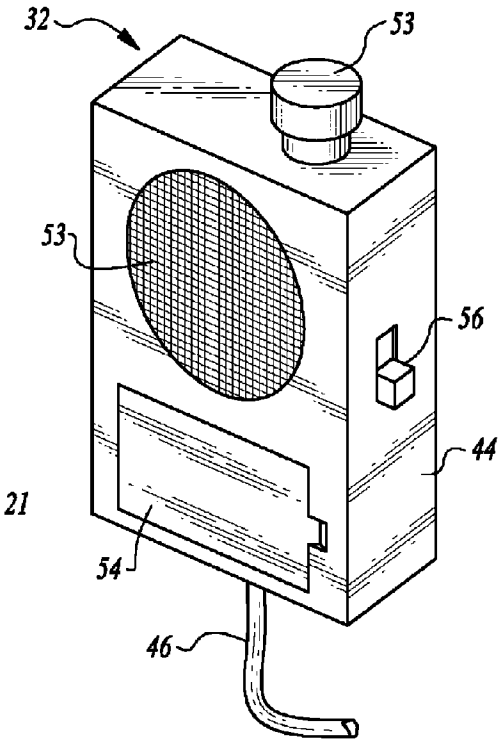
FIG. 3 is a perspective view of the transducer component of the detector assembly.

If a buzzer is employed, the aural output passes through grill 52 in housing 44. If a vibrator is used in transducer 32, the vibrator is mechanically coupled to the housing 44. As shown in FIG. 3, housing 44 also includes an on-off push button switch 53 to turn the transducer 32 on or off. A battery door 54 is also provided, to allow convenient access for battery replacement.

Figure 4:
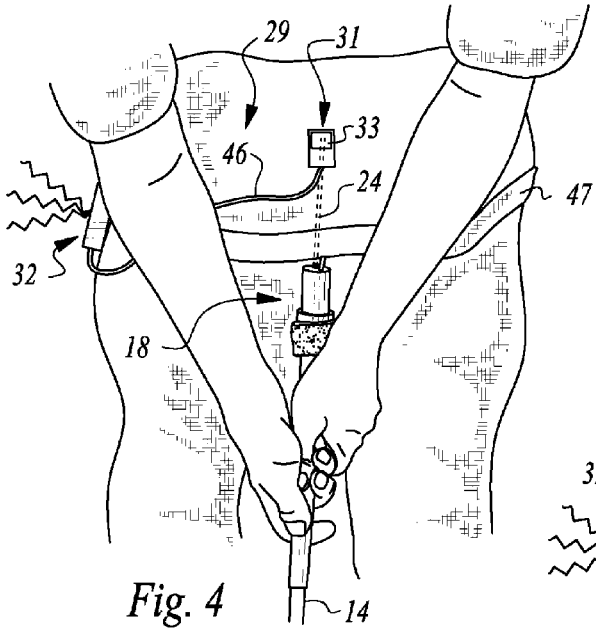
FIG. 4 is a front elevational view of a golfer preparing to take a swing of the putter, establishing the proper orientation for the club.
Figure 5:
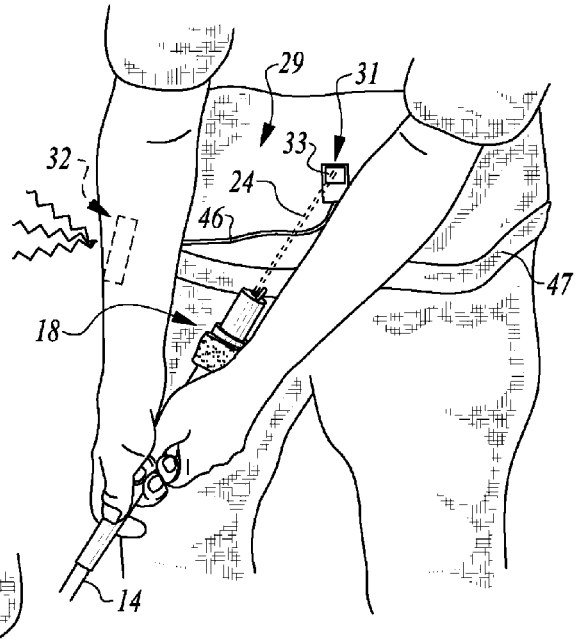
FIG. 5 is a view as in FIG. 4, but with the putter at the end of the backswing position while remaining in the proper orientation.
Figure 6:
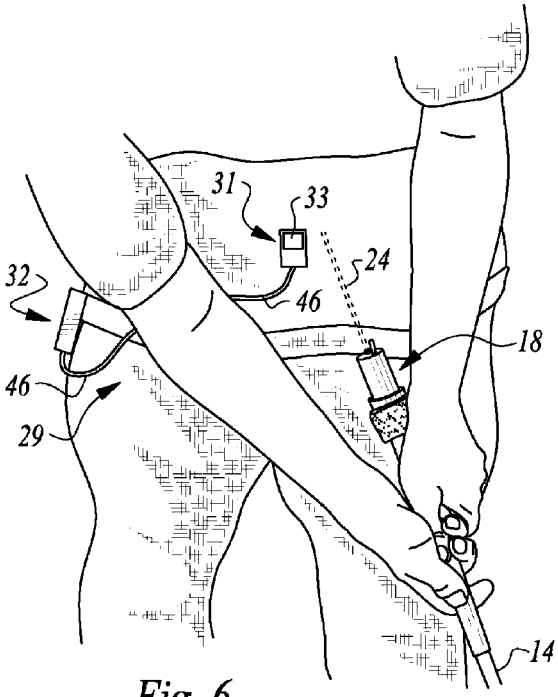
FIG. 6 is a view as in FIG. 4, but with the putter at the forward end of the stroke with the putter now in a misaligned orientation with respect to the light sensor of the detector assembly.
Figure 7:
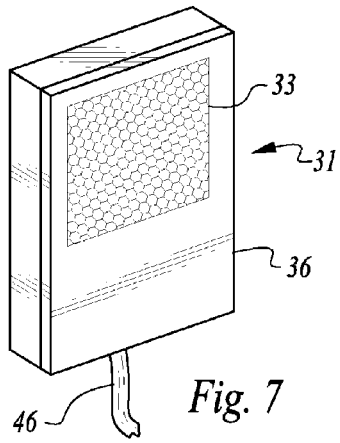
FIG. 7 is a perspective view of a typical light sensor, including a standard size photovoltaic cell imbedded in its face.

In operation, the transducer 32 produces a buzzing sound or a vibrating sensation, whenever the light sensor 31 detects the light beam 24 outputted from the illuminator 18. This buzz or vibration alerts the golfer that the club is following a correct path and position through the course of the golf swing. With such sensory feedback, the golfer develops muscle training for a consistent and correct swing pattern. This operation is depicted in FIGS. 4-6. As can be seen in FIGS. 4 and 5, the golfer has maintained the correct position of the club from the beginning of the swing up to and including the end of the backstroke. However, in FIG. 6, it is evident that the beam 24 has strayed from the target presented by the light sensor 31, indicating an incorrect position for the golfer's hands and arms as they are holding the shaft 14. By the time the club has reached the position shown in FIG. 6, the buzzing sound or vibrating sensation will have ceased, indicating to the golfer that correction is needed. Once correction of the position of the club throughout the entire stroke has been made, the golfer will experience continuous sensory feedback of that fact.

In the event the golfer learns better through a reverse sensory feedback, a reverse mode switch 56 is also provided on the side of housing 44. When reverse mode switch is activated, it is effective to reverse the operation of the transducer 32 so that it produces a buzzing sound or a vibratory sensation in the absence of a detected light beam 24.

Irrespective of the mode of operation, the buzz or vibration or the lack thereof, communicates to the golfer that the club is following a correct path and position through the course of the golf swing. With such sensory feedback, the golfer develops muscle training for a consistent and correct swing pattern.

What is claimed is:

1. A golf swing training device for use with a golf club, comprising:

a. an illuminator mounted on an upper end of the shaft of the golf club, said illuminator producing a beam of light wave energy directed away from the golf club along a path which is generally coincident with a longitudinal axis of the club shaft; and, b. a detector assembly including a light sensor and a transducer, said light sensor being sensitive to said beam produced by said illuminator and outputting an electrical signal in response thereto, said light sensor being worn by the golfer and strategically located around the stomach region of the golfer to define a target, said transducer being electrically interconnected to said light sensor and producing either a buzzing sound or a vibrating sensation whenever said beam strikes the target presented by said light sensor, whereby the buzz or vibration alerts the golfer that the club is following a correct path and position through the course of a golf swing.

2. A device as in claim 1 in which said light sensor includes a photovoltaic cell.

3. A device as in claim 2 further including a housing and a shroud fitted over said housing, selectively covering a portion of said photovoltaic cell and effectively reducing the size of said cell as a target for said illuminator.

4. A device as in claim 1 in which said light sensor includes a housing, and further including an optical bandpass filter fitted over said housing interposed between said illuminator and said light sensor, the transmission characteristics of said optical bandpass filter being selected to pass light wave energy produced by said illuminator and to absorb ambient light wave energy.

5. A device as in claim 1 in which said illuminator includes a laser diode and a timer to pulse encode the output of said diode.

6. A device as in claim 5 in which said transducer includes amplifier means to increase the amplitude of said electrical signal.

7. A device as in claim 1 further including a switch interconnected to said transducer, said switch being effective to reverse the operation of said transducer so that it produces a buzzing sound or a vibratory sensation in the absence of a detected light beam.

8. A device as in claim 1 in which an optical bandpass filter is located over said light sensor interposed between said illuminator and said light sensor, the transmission characteristics of said filter being selected to pass light wave energy produced by said illuminator and to absorb ambient light wave energy.

9. A device as in claim 1 in which said transducer includes amplifier means to increase the amplitude of said electrical signal.

10. A device as in claim 9 in which said amplifier means is a comparator.

11. A golf swing training device for use with a golf club, comprising:

a. an illuminator mounted on an upper end of the shaft of the golf club, said illuminator producing a beam of light wave energy directed away from the golf club along a path which is generally coincident with the longitudinal axis of the club shaft, said illuminator including a laser diode and means to pulse encode said beam produced by said laser diode; and, b. a detector assembly including a light sensor and a transducer, said light sensor being sensitive to said beam produced by said illuminator and outputting an electrical signal in response thereto, said light sensor being worn by the golfer and strategically located around the stomach region of the golfer to define a target, said transducer including amplifier means electrically interconnected to said light sensor to process said electrical signal, said amplifier means having an output interconnected either to a buzzer or a vibrator, whereby the buzz or vibration produced thereby alerts the golfer that the club is following a correct path and position through the course of a golf swing.

12. A device as in claim 11 in which said light sensor includes a photovoltaic cell.

13. A device as in claim 11 in which said amplifier means comprises a comparator.

14. A device as in claim 11 in which an optical bandpass filter is located over said light sensor interposed between said illuminator and said light sensor, the transmission characteristics of said filter being selected to pass light wave energy produced by said illuminator and to absorb ambient light wave energy.

15. A method for training a golfer, comprising the steps of:

a. providing a putter, said putter having an illuminator mounted on an upper end of the shaft of said putter, said illuminator producing a beam of light wave energy directed away from said putter along a path which is generally coincident with a longitudinal axis of said putter's shaft, said illuminator including a laser diode and means to pulse encode said beam produced by said laser diode b. providing a detector assembly including a light sensor and a transducer, said light sensor being sensitive to said beam produced by said illuminator and outputting an electrical signal in response thereto, said light sensor being worn by the golfer and strategically located around the stomach region of the golfer to define a target, said transducer including amplifier means electrically interconnected to said light sensor to process said electrical signal, said amplifier means having an output interconnected either to a buzzer or a vibrator; and c. producing either a buzz or a vibration, thereby alerting the golfer that the club is following a correct path and position through the course of a putting stroke, providing said beam remains directed upon said light sensor, during the course of said putting stroke.

16. A method as in claim 15 further including the step of providing an optical bandpass filter located over said light sensor, the transmission characteristics of said filter being selected to pass light wave energy produced by said illuminator and to absorb ambient light wave energy.

17. A method as in claim 15 in which said light sensor includes a photovoltaic cell.

18. A method as in claim 15 in which said amplifier means comprises a comparator.

19. A method as in claim 15 in which said light sensor and said transducer are physically separated, said transducer worn by the golfer in a location removed from the stomach region of the golfer and being interconnected to said light sensor by means of a wire.

20. A method as in claim 19 in which said removed location is on the belt or trousers of the golfer.

* * * * *